US009373491B2

(12) United States Patent
Nakamura et al.

(10) Patent No.: US 9,373,491 B2
(45) Date of Patent: Jun. 21, 2016

(54) MASS SPECTROMETER

(71) Applicant: CANON ANELVA CORPORATION, Kawasaki-shi (JP)

(72) Inventors: Megumi Nakamura, Kwasaki (JP); Masayuki Sugiyama, Kawasaki (JP); Lei Chen, Kawasaki (JP); Yoshiyuki Takizawa, Kawasaki (JP)

(73) Assignee: CANON ANELVA CORPORATION, Kawasaki-Shi (JP)

( * ) Notice: Subject to any disclaimer, the term of this patent is extended or adjusted under 35 U.S.C. 154(b) by 0 days.

(21) Appl. No.: 14/722,868

(22) Filed: May 27, 2015

(65) Prior Publication Data

US 2015/0262807 A1 Sep. 17, 2015

Related U.S. Application Data

(63) Continuation of application No. PCT/JP2013/004919, filed on Aug. 20, 2013.

(30) Foreign Application Priority Data

Dec. 27, 2012 (JP) ..... 2012-284220

(51) Int. Cl.

| | |
|---|---|
| ***H01J 49/00*** | (2006.01) |
| ***H01J 49/42*** | (2006.01) |
| ***H01J 49/02*** | (2006.01) |
| ***H01J 49/14*** | (2006.01) |
| ***H01J 49/24*** | (2006.01) |

(52) U.S. Cl.

CPC ..... *H01J 49/4215* (2013.01); *H01J 49/025* (2013.01); *H01J 49/147* (2013.01); *H01J 49/24* (2013.01)

(58) Field of Classification Search

USPC ..... 250/281, 282, 288, 289, 493.1

See application file for complete search history.

(56) References Cited

U.S. PATENT DOCUMENTS

| | | | |
|---|---|---|---|
| 5,889,281 | A | 3/1999 | Holkeboer et al. |
| RE38,138 | E | 6/2003 | Holkeboer et al. |
| 6,642,641 | B2 | 11/2003 | Ellefson et al. |
| 6,800,848 | B2 | 10/2004 | Shiokawa et al. |
| 8,296,090 | B2 | 10/2012 | Aoki et al. |

FOREIGN PATENT DOCUMENTS

| | | | |
|---|---|---|---|
| JP | 9-92200 | A | 4/1997 |
| JP | 11-31473 | A | 2/1999 |

(Continued)

OTHER PUBLICATIONS

International Preliminary Report on Patentability in International Application No. PCT/JP2013/004919 (issued Jun. 30 2015).

(Continued)

*Primary Examiner* — Nicole Ippolito
*Assistant Examiner* — Hanway Chang
(74) *Attorney, Agent, or Firm* — Fitzpatrick, Cella, Harper & Scinto

(57) ABSTRACT

An object of the present invention is to provide a mass spectrometer having a simple structure and being capable of precisely measuring a total pressure and performing mass spectrometry with high precision. A mass spectrometer according to one embodiment includes a quadrupole configured to selectively pass therethrough an ion of a target gas having a predetermined mass-to-charge ratio among components of a measurement gas ionized by an ion source, an ion detector configured to detect an ion current value based on the ion of the target gas that passes through the quadrupole, a total pressure measurer configured to detect a photoelectric current value based on vacuum ultraviolet light generated when the ion source ionizes the measurement gas, and an arithmetic unit configured to calculate a partial pressure of the target gas by using the photoelectric current value and the ion current value.

4 Claims, 4 Drawing Sheets

(56) References Cited

FOREIGN PATENT DOCUMENTS

| | | | |
|---|---|---|---|
| JP | 2001-351568 | A | 12/2001 |
| JP | 4932532 | B2 | 5/2012 |
| WO | 2008/129929 | A1 | 10/2008 |
| WO | 2011/081188 | A1 | 7/2011 |

OTHER PUBLICATIONS

International Search Report in International Application No. PCT/JP2013/004919 (mailed Oct. 15, 2013).

MASS SPECTROMETER

CROSS-REFERENCES TO RELATED APPLICATIONS

This application is a continuation application of International Application No. PCT/JP2013/004919, filed Aug. 20, 2013, which claims the benefit of Japanese Patent Application No. 2012-284220 filed Dec. 27, 2012. The contents of the aforementioned applications are incorporated herein by reference in their entireties.

TECHNICAL FIELD

The present invention relates to a mass spectrometer.

BACKGROUND ART

In measuring a pressure space at around 1 Pa using a mass spectrometer, ions collide with a gas molecule while passing through a quadrupole, so that the trajectory course of the ions is disturbed in some cases. This phenomenon is likely to occur under a pressure condition with a short mean free path.

At a pressure of approximately 1E-2 Pa or less, the probability of the collision between ions and a gas in a quadrupole is so low that a decrease in the efficiency of ions reaching an ion detector can be ignored. However, at a pressure of approximately 1E-2 Pa or more, the decrease in the efficiency of ions reaching an ion detector cannot be ignored. Consequently, an ion current value corresponding to a pressure lower than an actual partial pressure is detected at a pressure of approximately 1E-2 Pa or more.

For example, at 1 Pa at which a sputtering process is carried out, the mean free path of an Ar gas is 6.4 mm, and ions are likely to collide with a gas molecule in a quadrupole. Specifically, in a gas analysis at a pressure around 1 Pa, ions are difficult to pass through a quadrupole, so that an amount of ions detected by an ion detector is reduced and is no longer proportional to an amount of ions generated in an ion source. This results in a failure to ensure a linearity between the pressure and the amount of ions detected.

For correcting a measurement value in a mass spectrometry, an apparatus is known which is configured to: measure a total pressure at the time of mass spectrometry; and correct an amount of ions detected with reference to a pre-measured correlation curve between the total pressure and the amount of ions detected. For example, according to the techniques disclosed in Patent Documents 1 and 2, a total pressure is measured by measuring ions generated in an ion source of a mass spectrometer without passing the ions through a mass analyzer. Moreover, in the technique disclosed in Patent Document 3, a total pressure is calculated from a detection value (equivalent to an ion current value corresponding to a mass-to-charge ratio at which no peak appears in Patent Document 3) of a photoelectron generated as a result of irradiating an ion detector disposed at the next stage of a mass analyzer with vacuum ultraviolet light generated in an ionization chamber when a measurement gas is ionized.

CITATION LIST

Patent Documents

Patent Document 1: U.S. Pat. No. 5,889,281
Patent Document 2: U.S. Pat. No. 6,642,641
Patent Document 3: Japanese Patent No. 4932532

SUMMARY OF INVENTION

Technical Problem

Nevertheless, the techniques as in Patent Documents 1 and 2 have problems that measuring ions generated in an ion source of a mass spectrometer without passing the ions through a mass analyzer requires the ion source to have a complicated structure, increasing the number of parts and the cost. Moreover, the technique as in Patent Document 3 requires a sufficient amount of vacuum ultraviolet light to be generated in an ion source in order to calculate a total pressure by irradiating an ion detector disposed at the next stage of a mass analyzer with the vacuum ultraviolet light. However, the vacuum ultraviolet light with which the ion detector is irradiated appears as a noise during mass spectrometry. From the viewpoint of increasing the precision of the mass spectrometry, the vacuum ultraviolet light should be suppressed; otherwise, this brings about a problem that it is difficult to measure a total pressure precisely.

The present invention has been made in view of the above-described problems. An object of the present invention is to provide a mass spectrometer having a simple structure and being capable of precisely measuring a total pressure and performing mass spectrometry with high precision.

Solution to Problem

A mass spectrometer according to an aspect of the present invention comprises: an ionizer configured to ionize a measurement gas; a filter configured to selectively pass therethrough an ion of a target gas having a predetermined mass-to-charge ratio among components of the measurement gas ionized by the ionizer; an ion detector configured to detect an ion detection value based on the ion of the target gas that passes through the filter; a light detector configured to detect a light detection value based on vacuum ultraviolet light generated when the ionizer ionizes the measurement gas; and an arithmetic unit configured to calculate a partial pressure of the target gas by using the light detection value and the ion detection value.

Advantageous Effects of Invention

The present invention makes it possible to provide a mass spectrometer capable of performing total pressure measurement and mass spectrometry with high precision while having a relatively simple structure. Moreover, according to the present invention, the relatively simple configuration makes it possible to provide a mass spectrometer capable of suppressing increases in the maintenance cost and production cost.

DESCRIPTION OF EMBODIMENTS

Hereinafter, an embodiment of the present invention will be described in detail with reference to the drawings. It should be noted that the present invention is not limited to the following embodiment, and changes may be made as appropriate to carry out the invention without departing from the spirit of the present invention.

Figure 1:
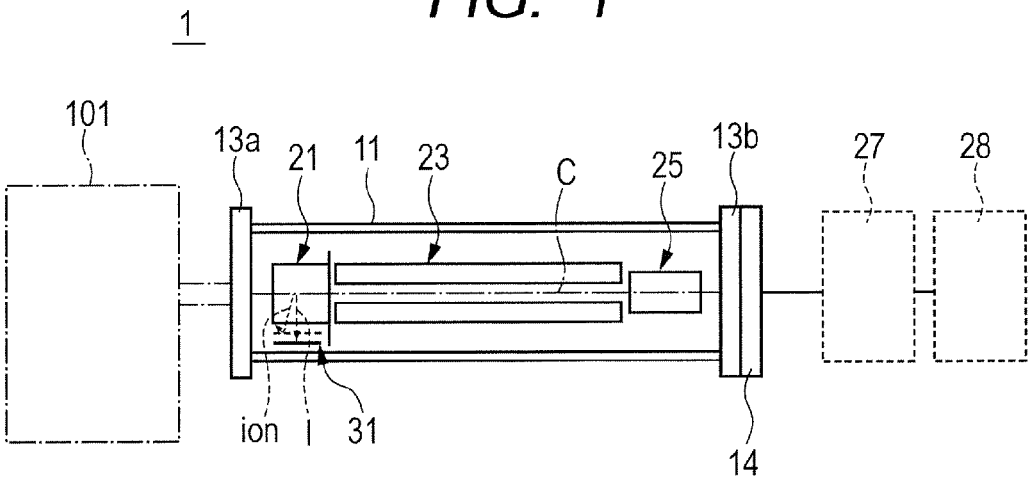
FIG. 1 is a schematic configuration diagram of a mass spectrometer according to an embodiment of the present invention.
Figure 2A:
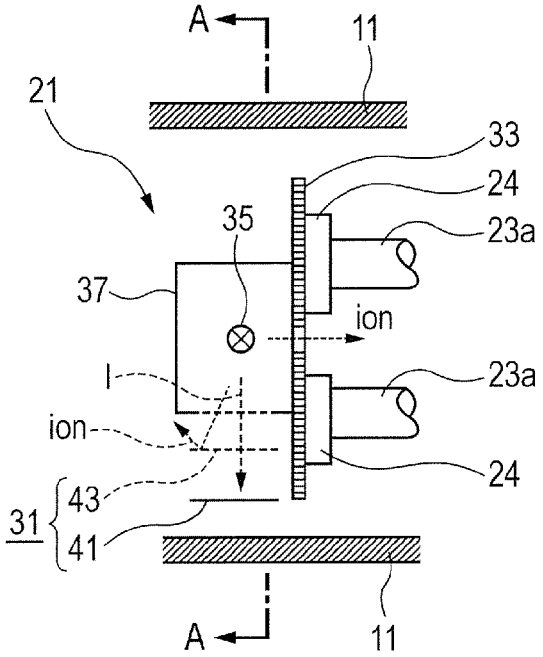
FIG. 2A is a schematic view of an enlarged ion source in FIG. 1.
Figure 2B:
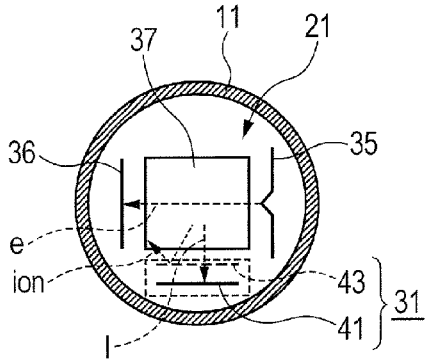
FIG. 2B is a cross-sectional view of the ion source in FIG. 1.

FIG. 1 is a schematic configuration diagram of a mass spectrometer. FIGS. 2A and 2B are schematic views of enlarged sections corresponding to an ion source of the mass spectrometer shown in FIG. 1. The mass spectrometer 1 is formed by arranging, inside a nipple 11, four main constituent elements: an ion source (ionizer) 21, a quadrupole (filter) 23, an ion detector 25, and a total pressure measurer (light detector) 31. The nipple 11 is a cylindrical member having both ends provided with flanges 13*a*, 13*b*, respectively. The nipple 11 is configured to be capable of producing a vacuum therein by evacuation. Of the two flanges 13*a*, 13*b* at the nipple 11, the flange 13*a* is a connector for attaching thereto a measurement chamber 101 to be measured. During the measurement, the inside of the nipple 11 communicates with the inside of the measurement chamber 101, and a gas (measurement gas) inside the nipple 11 has the same pressure and the same components as those inside the measurement chamber 101 (measurement space). The flanges 13*b* is connected to a base flange 14 to which a controller 27 to be described later is attached. The ion detector 25 and the total pressure measurer (light detector) 31 are connected to the controller 27 with a cable. The controller 27 is disposed outside the nipple 11.

The ion detector 25 is fixed to the base flange 14 with an unillustrated insulating material interposed therebetween. The quadrupole 23 is fixed to an opposite side of the ion detector 25 from an end portion to which the base flange 14 is attached, with an unillustrated insulating material interposed between the quadrupole 23 and the ion detector 25. Further, the ion source 21 is attached to an opposite side of an end portion of the quadrupole 23 to which the ion detector 25 is attached, with an insulating material 24 and an ion chamber base 33 interposed between the ion source 21 and the quadrupole 23.

The ion source (ionizer) 21 is configured to ionize a measurement gas introduced from the inside of the measurement chamber 101, and is provided to the ion chamber base 33 disposed on the quadrupole 23 side. The ion chamber base 33 is provided with a filament 35, an electron collector 36, and an ion chamber 37. The ion chamber 37 is disposed between the filament 35 and the electron collector 36. The filament 35 is heated by electric current thereby generate thermal electrons e. Causing the thermal electrons e to collide with a gas ionizes a measurement gas. A potential gradient provided in the ion source 21 sends the ions ionized by the ion source 21 toward the quadrupole 23.

The total pressure measurer (light detector) 31 is configured to detect a photoelectric current detection value (light detection value) according to a total pressure, and is attached to the ion chamber base 33. The total pressure measurer 31 is disposed laterally to a course in which the thermal electrons e are emitted from the filament 35. Since the total pressure measurer 31 is disposed laterally to the course in which the thermal electrons e are emitted, the total pressure measurer 31 receives fewer electrons but is likely to receive a electromagnetic wave (vacuum ultraviolet light) generated when a measurement gas is ionized in the ion chamber 37.

The quadrupole (filter) 23 is a filter configured to selectively pass therethrough an ion of a target gas having a predetermined mass-to-charge ratio. The quadrupole (filter) 23 is located in the middle between the ion source 21 and the ion detector 25, and is constituted of four metallic columnar rods (rods) 23*a*. Each of the rods 23*a* is disposed parallel to the others at equal intervals along a central axis C. The quadrupole 23 is connected to a power supply configured to apply to each rod 23*a* a voltage in which a direct voltage is superimposed on an alternating voltage at a specific frequency. Setting a voltage to be applied to each rod 23*a* makes it possible to pass only ions having a predetermined mass-to-charge ratio to the ion detector 25 side. Further sweeping the voltage makes it possible to change the mass-to-charge ratio of ions passing therethrough.

The ion detector 25 is a unit configured to detect an ion current detection value (ion detection value) of an ion of an incident target gas. The ion detector 25 and the total pressure measurer (light detector) 31 are connected to the controller 27 with the cable. The controller 27 is further connected to an arithmetic unit (computer) 28.

The arithmetic unit 28 is connected to the controller 27 and is configured to include at least a computer. When the controller 27 receives an ion current detected by the ion detector 25, the controller 27 causes the arithmetic unit 28 to execute a computation based on the ion current. The arithmetic unit 28 outputs or displays an ion current detection value for each mass-to-charge ratio as the processing result. An ion current detection value represents an amount of incident ions, and the ion current detection value can identify components of a gas, serving as a measurement target (target gas), in the vacuum chamber. Moreover, the arithmetic unit 28 has functions to calculate a corrected ion current value for the target gas by using the ion current detection value detected by the ion detector 25 and the photoelectric current detection value detected by the total pressure measurer 31, and also to calculate an accurate partial pressure of the target gas by using the corrected ion current value. Note that, in the present embodiment, the arithmetic unit 28 is formed separately from the controller 27, but the controller 27 and the arithmetic unit 28 may be formed integrally. Meanwhile, although the controller 27 and the arithmetic unit 28 are formed separately from the mass spectrometer 1, the two may be formed as parts of the mass spectrometer.

The ion source 21 will be described in more details based on FIGS. 2A and 2B. FIG. 2A is a schematic view of an enlarged section corresponding to the ion source 21 of the mass spectrometer 1 shown in FIG. 1, and FIG. 2B is a cross-sectional view taken along the A-A direction in FIG. 2A. As described above, the main parts of the ion source 21 are constituted of the ion chamber 37, the filament 35, and the electron collector 36 which are attached to the ion chamber base 33.

The ion chamber base 33 is attached to the insulating material 24 provided on the quadrupole 23 side, and is a conductive member to which the ion chamber 37, the total pressure measurer 31, and the like are attached. The ion chamber 37 is a rectangular parallelepiped box-shaped member attached to the ion chamber base 33, and is provided with openings at predetermined positions in such a manner that the thermal electrons (e), ions (ion), and vacuum ultraviolet light (l) can pass therethrough. For example, surfaces of the ion chamber 37 facing the filament 35 and the electron collector 36 are provided with openings through which the thermal electrons e can pass. A surface of the ion chamber 37 facing the ion detector 25 is provided with an opening through which ions can pass. A surface of the ion chamber 37 facing the total pressure measurer 31 is provided with an opening through which the vacuum ultraviolet light l can pass. The filament 35 and the electron collector 36 are attached in such a manner as to face each other with the ion chamber base 33 in between. The electron collector 36 also serves as an electrode for absorbing the thermal electrons e emitted from the filament 35 and measuring the amount of the thermal electrons e emitted.

The total pressure measurer 31 is attached to a position at which the total pressure measurer 31 does not receive the thermal electrons e from the filament 35. Specifically, the total pressure measurer 31 is provided laterally (for example, in a substantially perpendicular direction) to the course from the filament 35 toward the electron collector 36. Such an arrangement makes it possible to suppress the incidence on the total pressure measurer 31 of the thermal electrons e traveling from the filament 35 to the electron collector 36. The total pressure measurer 31 includes a vacuum ultraviolet light detector 41 of the vacuum ultraviolet light l and an ion blocking electrode 43. The total pressure measurer 31 is a unit configured to detect a signal according to a pressure (total pressure) inside the ion source 21, by utilizing the vacuum ultraviolet light l generated concomitantly when a gas is ionized using thermal electrons in the ion source 21. In the ion chamber 37, the thermal electrons e emitted from the filament 35 collide with a measurement gas and ionize the measurement gas. The gas ions ionized in the ion chamber 37 travel toward the ion detector 25 through the quadrupole 23. A portion of the vacuum ultraviolet light l generated in the ion chamber 37 enters the vacuum ultraviolet light detector 41 of the total pressure measurer 31. The amount of the vacuum ultraviolet light l generated in the ion chamber 37 is proportional to the total pressure of the measurement gas. Since the vacuum ultraviolet light l is measured in the total pressure measurer 31, the detection precision never falls even under a higher pressure unlike a case where ions are measured. This is because the trajectory of the vacuum ultraviolet light l is not disturbed by the collision with a gas molecule or the like.

Moreover, the total pressure measurer 31 is provided laterally (for example, substantially perpendicular direction) to the course from the ion source 21 toward the ion detector 25. This configuration makes it possible to detect the vacuum ultraviolet light l near the ion source 21 in comparison with a mode as in Patent Document 3 in which the ion detector 25 detects the vacuum ultraviolet light l. Hence, it is possible to measure a total pressure with high precision without increasing the intensity of the vacuum ultraviolet light l, and to suppress the vacuum ultraviolet light l in the form of noise in the ion detection.

The vacuum ultraviolet light detector 41 is a collector configured to detect a photoelectric current generated according to the amount of an electromagnetic wave (vacuum ultraviolet light l) incident on a detection surface thereof, and is provided near the ion source 21. Hence, it is possible to detect the vacuum ultraviolet light l with high sensitivity. The detection surface which receives the vacuum ultraviolet light l to generate photoelectrons is disposed parallel to the course in which the thermal electrons e are emitted from the filament 35. This makes it possible to reduce the number of the thermal electrons e and ions incident on the detection surface. The ion blocking electrode 43 is a member, configured to block ions generated in the ion source from entering the vacuum ultraviolet light detector. The ion blocking electrode is a mesh-like member disposed between the ion source and the vacuum ultraviolet light detector, and is supplied with a positive potential in such a manner as to prevent the ions from entering the vacuum ultraviolet light detector 41. The ion blocking electrode 43 of the present embodiment is disposed parallel to the detection surface of the vacuum ultraviolet light detector. With such a configuration, the ion blocking electrode 43 having a positive potential blocks the ions generated in the ion source from reaching the vacuum ultraviolet light detector 41. Meanwhile, the vacuum ultraviolet light generated concomitantly with the ionization passes through openings of the mesh of the ion blocking electrode 43, and is detected by the vacuum ultraviolet light detector 41.

The ion blocking electrode 43 also has a function to facilitate the photoelectron emission from the vacuum ultraviolet light detector 41. Specifically, while the potential of the vacuum ultraviolet light detector 41 is a ground potential, the potential of the ion chamber 37 generating ions in the ion source 21 is positive several V in many cases. Hence, to block ions having an energy of positive several V from coming into contact with the vacuum ultraviolet light detector 41, a higher potential (for example, from positive more than ten to several tens V) is applied to the ion blocking electrode 43. As a result, an electrode having a positive potential is located immediately near the vacuum ultraviolet light detector 41, so that photoelectrons are likely to be drawn from the vacuum ultraviolet light detector 41.

Figure 3:
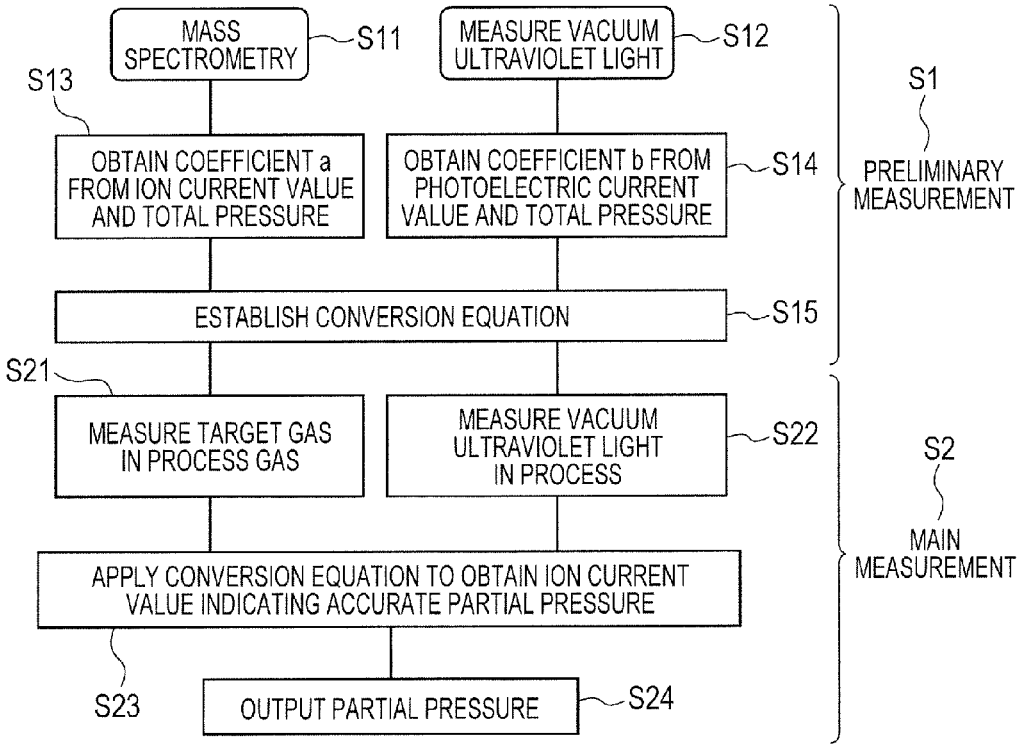
FIG. 3 is a flowchart for illustrating a method for measuring a partial pressure by using the mass spectrometer according to the embodiment of the present invention.

Now, a process of deriving a correction equation for partial pressure measurement using the mass spectrometer of the present embodiment will be described based on a flowchart shown in FIG. 3. First, description will be given of a procedure for obtaining an ion current value (corrected value), which indicates an accurate partial pressure of a target gas, from a current detection value (photoelectric current detection value) of the vacuum ultraviolet light l detected by the total pressure measurer 31 and an ion current detection value detected by the ion detector 25.

Suppose that $F^{-1}$ represents a decrease in the efficiency at which ions generated in the ion source 21 reach the ion detector 25. In this case, the following equation (1) is satisfied, where F represents a correction coefficient for obtaining an ion current value Ic, which indicates an accurate partial pressure, from an ion current detection value (ion current value) Id.

[Math. 1]

$$Ic=F\times Id \tag{1}$$

$F^{-1}$ can be expressed by $\exp(-A/\lambda)$, where $\lambda$ represents the mean free path of a gas. Further, since $\lambda$ is inversely proportional to a total pressure Pt, $\exp(-a\cdot Pt)$ holds. Thus, the following equation (2) is satisfied.

[Math. 2]

$$F=\frac{1}{\exp(-a\cdot Pt)} \tag{2}$$

On the other hand, a current detection value Iu of the vacuum ultraviolet light l is proportional to a total pressure Pt, and accordingly expressed as in an equation (3).

[Math. 3]

$$Iu=b\cdot Pt \tag{3}$$

By solving these, Ic is expressed as functions of Id and Iu as in an equation (4).

[Math. 4]

$$Ic=\frac{1}{\exp(-a\cdot Iu/b)}\times Id \tag{4}$$

In this manner, the ion current value (corrected ion current value) Ic indicating an accurate partial pressure can be obtained from the current detection value (photoelectric current detection value) Iu of the vacuum ultraviolet light l and the ion current detection value Id. The coefficients a, b are calculated for each component of a gas, and stored in the controller 27 of the mass spectrometer 1. The coefficients a, b are calculated and stored before the mass spectrometer 1 measures a measurement gas.

A method for measuring a partial pressure of process gas by using the mass spectrometer 1 according to the present embodiment will be described by taking as an example Ar, a main component of a process gas in a film formation process by sputtering. First, description will be given of a section of a preliminary measurement S1 in the flowchart of FIG. 3. Note that the measurement target gas of the present embodiment is not limited to Ar. In a case where a gas other than Ar is to be measured, the correction function of the measurement gas (target gas) should be obtained independently.

Figure 4:
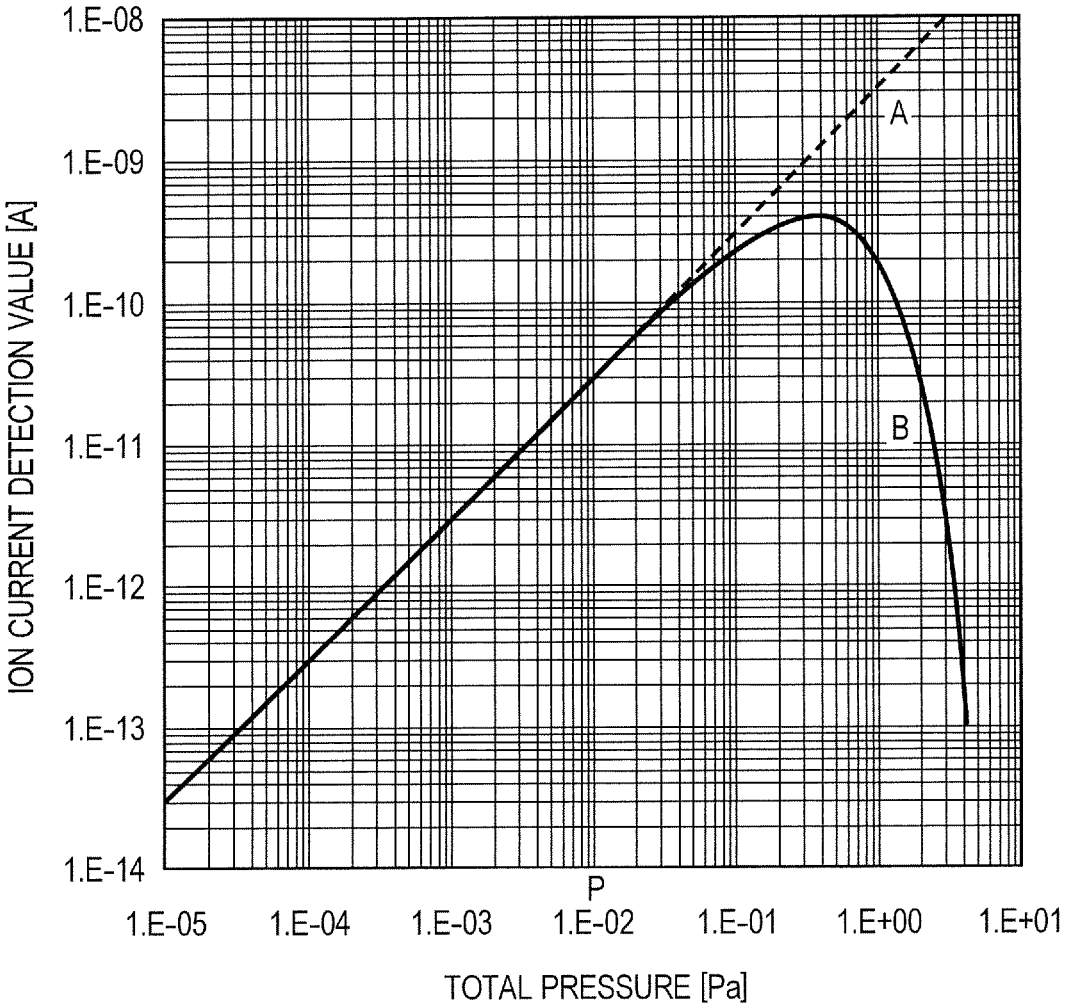
FIG. 4 is a graph showing a relation between the total pressure and the ion current detection value of an Ar ion before correction detected by using the mass spectrometer according to the embodiment of the present invention.
Figure 5:
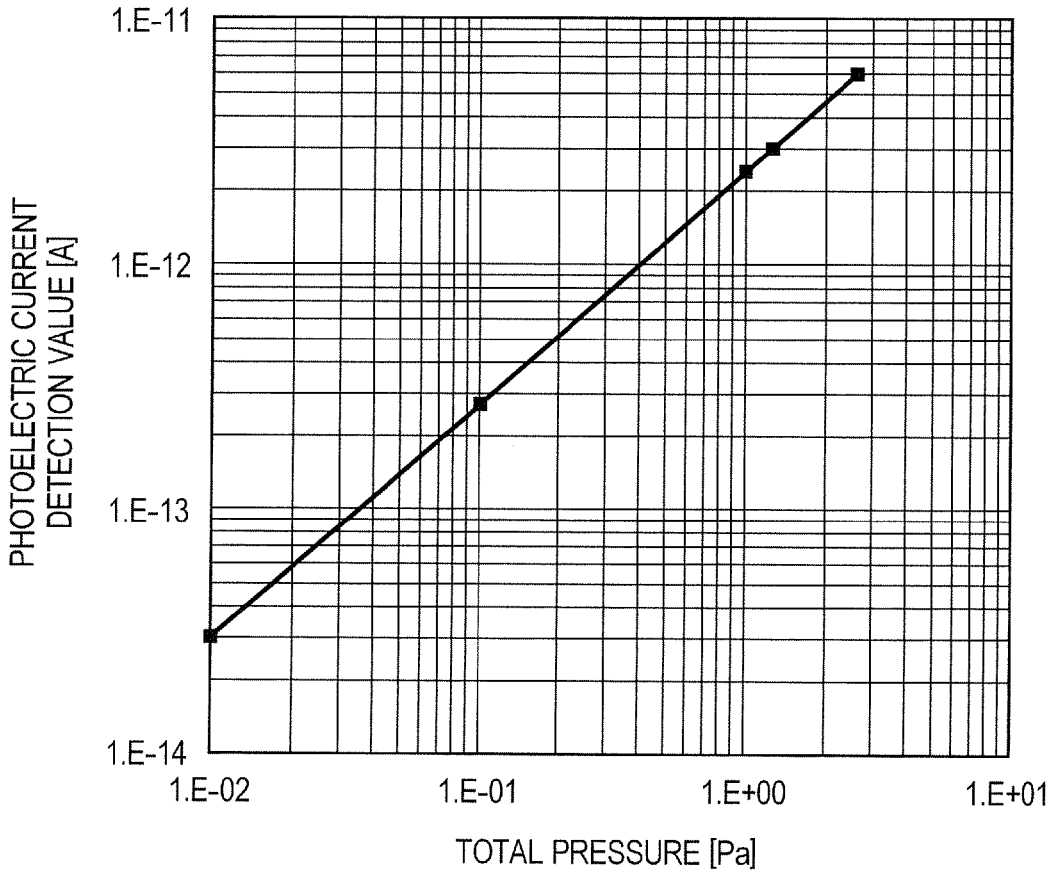
FIG. 5 is a schematic graph showing a relation between the total pressure and the photoelectric current detection value of vacuum ultraviolet light obtained by using the mass spectrometer according to the embodiment of the present invention.

Once a vacuum chamber 101 is attached to the mass spectrometer 1 and evacuated to a high vacuum (for example, 1E-6 Pa), Ar is then introduced. Subsequently, the ion current detection value of the Ar gas-derived ion having a mass-to-charge ratio m/z of 40 is measured at each pressure (step S11), and the photoelectric current detection value of the vacuum ultraviolet light l is also measured at each pressure (step S12). At the preliminary measurement stage, the total pressure is measured using a different pressure gauge (for example, a capacitance diaphragm gauge or the like). These measurements are continued from the high vacuum to the total pressure of approximately 2.6 Pa to thereby obtain a graph of the ion current value (ion current detection value) of the Ar ion in relation to the pressure as represented by the solid line B in FIG. 4, and a graph of the current detection value (photoelectric current detection value) of the vacuum ultraviolet light in relation to the pressure in FIG. 5. Note that the broken line A in FIG. 4 represents an ion current detection value obtained under the assumption that the ions do not collide with a gas in the quadrupole.

The coefficient a in the equation (2) is obtained from the graph of the ion current detection value of the mass-to-charge ratio m/z of 40 and the total pressure (step S13). In this exemplified case, the following equation (5) holds.

[Math. 5]

$$F=\frac{1}{\exp(-2.79\cdot Pt)} \tag{5}$$

Next, the coefficient b in the equation (3) is obtained from the graph of the photoelectric current detection value of the vacuum ultraviolet light l and the total pressure (step S14). In this exemplified case, the following equation (6) holds.

[Math. 6]

$$Iu=2.27\times10^{-12}\cdot Pt \tag{6}$$

Finally, substituting the coefficient a and the coefficient b in the equation (4) obtains a conversion equation by which Ic is calculated from Id and Iu (step S15). In this exemplified case, the following equation (7) holds.

[Math. 7]

$$Ic=\frac{1}{\exp(-2.79\cdot Iu/2.27\times10^{-12})}\times Id \tag{7}$$

Next, a section of a main measurement S2 in the flowchart of FIG. 3 will be described. Here, description will be given of a case where the ion current detection value (ion detection value) of Ar is corrected. The mass spectrometer 1 is driven to measure the ion current detection value of the mass-to-charge ratio m/z of 40 (step S21), and also to measure the photoelectric current detection value (light detection value) of the vacuum ultraviolet light (step S22). Then, the ion current detection value Id and the photoelectric current detection value Iu are substituted in the conversion equation obtained in step S15 to thereby calculate an ion current value (corrected ion current value) Ic related to a partial pressure after the correction (step S23). Subsequently, the partial pressure is corrected using the calculated Ic and outputted (step S24).

In the present embodiment, the description has been given of the example in which the preliminary measurement S1 and the main measurement S2 are successively performed. Nevertheless, after the conversion equation is established in the preliminary measurement S1, the main measurement S2 may be performed multiple times. Alternatively, in a case where the conversion equation is obtained in advance, only the main measurement S2 may be performed without performing the preliminary measurement S1.

According to the mass spectrometer 1 of the present invention, a total pressure is measured using the vacuum ultraviolet light generated concomitantly with the ionization, so that the total pressure inside a measurement space can be measured without passing ions through the quadrupole. Hence, even in a case where the measurement pressure is high, the total pressure can be measured precisely. Moreover, since the vacuum ultraviolet light used for the total pressure measurement is detected using the total pressure measurer provided separately from the ion detector, this enables the total pressure measurement without increasing the intensity of the vacuum ultraviolet light, and can suppress the vacuum ultraviolet light in the form of noise in the ion detection. Further, the total pressure measurer 31 of the present invention has a simple configuration. Accordingly, it is possible to provide a mass spectrometer capable of partial pressure measurement with high precision while preventing increases in costs necessary for the maintenance and production.

The present invention is not limited to the above-described embodiment, and can be changed as appropriate without departing from the gist of the present invention. For example, in the present embodiment, the vacuum ultraviolet light detector 41 configured to detect the vacuum ultraviolet light is provided at one lateral position in the ion source 21. Nevertheless, the present invention is not limited thereto. The vacuum ultraviolet light detector 41 may be provided at one position above the ion source 21, at multiple positions, or in a cylindrical form. Moreover, in the present embodiment, the description has been given of the case where the quadrupole mass spectrometer attached to the measurement target is a sputtering apparatus. Nevertheless, the mass spectrometer of the present invention may be used in various vacuum apparatuses such as a dry etching apparatus and a surface modification apparatus, in addition to film formation apparatuses such as a vacuum vapor deposition apparatus and a CVD apparatus.

The invention claimed is:

1. A mass spectrometer comprising:

an ionizer configured to ionize a measurement gas;

a filter configured to selectively pass therethrough an ion of a target gas having a predetermined mass-to-charge ratio among components of the measurement gas ionized by the ionizer;

an ion detector configured to detect an ion detection value based on the ion of the target gas that passes through the filter;

a light detector configured to detect a light detection value based on vacuum ultraviolet light generated when the ionizer ionizes the measurement gas; and an arithmetic unit configured to calculate a partial pressure of the target gas by using the light detection value and the ion detection value, wherein the light detector comprises:

a vacuum ultraviolet light detector configured to detect a photoelectric current value according to the vacuum ultraviolet light incident thereon; and an ion blocking electrode configured to block ions from entering the vacuum ultraviolet light detector.

2. The mass spectrometer according to claim 1, wherein the vacuum ultraviolet light detector has a detection surface disposed parallel to a course in which thermal electrons are emitted in the ionizer.

3. The mass spectrometer according to claim 1, wherein:

the vacuum ultraviolet light detector has a ground potential;

the ion blocking electrode has a positive potential; and the ion blocking electrode is disposed parallel to a detection surface of the vacuum ultraviolet light detector.

4. The mass spectrometer according to claim 1, wherein the light detector is provided at one of a position laterally to a course in which the ion of the target gas travels from the ionizer to the filter and a position above the course.

* * * * *